US005575264A

United States Patent [19]

Barron

[11] Patent Number: 5,575,264

[45] Date of Patent: Nov. 19, 1996

[54] USING EEPROM TECHNOLOGY IN CARRYING PERFORMANCE DATA WITH A FUEL INJECTOR

[75] Inventor: Richard Barron, Williamsburg, Va.

[73] Assignee: Siemens Automotive Corporation, Auburn Hills, Mich.

[21] Appl. No.: 579,081

[22] Filed: Dec. 22, 1995

[51] Int. Cl.[6] ..... F02M 51/00

[52] U.S. Cl. ..... 123/486; 123/72; 73/119 A

[58] Field of Search ..... 123/486, 489, 123/472, 434, 468, 470, 480; 73/119 A; 29/602 R; 364/431.12

[56] References Cited

U.S. PATENT DOCUMENTS

| | | | |
|---|---|---|---|
| 4,402,294 | 9/1983 | McHugh et al. | 123/480 |
| 4,584,981 | 4/1986 | Tanabe et al. | 123/472 |
| 4,884,546 | 12/1989 | Sogawa | 123/486 |
| 5,086,743 | 2/1992 | Hickey | 123/468 |
| 5,168,857 | 12/1992 | Hickey | 123/468 |
| 5,200,900 | 4/1993 | Adrian et al. | 364/431.12 |
| 5,293,317 | 3/1994 | Adrian et al. | 364/431.12 |
| 5,323,749 | 6/1994 | Gras et al. | 123/470 |

*Primary Examiner*—Raymond A. Nelli
*Attorney, Agent, or Firm*—Russel C. Wells

[57] ABSTRACT

A method for retaining and recalling technical data associated with a solenoid-operated fuel injector improves engine emissions. Each fuel injector is tested to generate technical data specifications relating to the fuel injector. The technical data specifications are then transferred to a memory means, such as an EEPROM memory chip, which is attached to the fuel injector. The injector then carries its unique technical data specifications. The technical data specifications can then be read from the fuel injector and the recalled technical data specifications are provided to a vehicle computer. The vehicle computer adjusts for variations between fuel injectors to collapse variability of injectors to a single, centered injector flow.

6 Claims, 1 Drawing Sheet

USING EEPROM TECHNOLOGY IN CARRYING PERFORMANCE DATA WITH A FUEL INJECTOR

FIELD OF THE INVENTION

This invention relates generally to electrically operated valves, such as fuel injectors for injecting liquid fuel into an internal combustion engine, and particularly to a method for carrying fuel injector data with the fuel injector.

BACKGROUND OF THE INVENTION

The movement of certain electrically-operated valves, such as certain fuel injectors, comprises a needle that is reciprocated axially within the interior of the valve's body in response to electrical energization and de-energization of an electro-mechanical actuator to thereby selectively open and close a flow path through the valve. Fuel injectors typically contain a solenoid assembly that includes an electromagnetic coil which, when energized, is operative to effect axial movement of an armature.

The state of the art contains a substantial number of patents relating to fuel injector solenoid designs. Typically, a solenoid valve comprises an armature movable between a first and second position for causing a needle valve to contact and separate from a valve seat. The basic solenoid design includes a coil, a stationary ferromagnetic pole, and the movable ferromagnetic armature. The armature is kept separated from the pole by a force such as gravity, spring, or pressure.

Manufacturers of gasoline engines specify in the product engineering specifications the static and dynamic flow rates of a fuel injector. This specification has applied limits typically of +/−3.2% for static flow and +/−3% for dynamic flow. In the manufacturing process, fuel injectors are tested 100% for these characteristics and those falling outside these limits are discarded. Those inside the limits fit a normal statistical distribution typically displayed as a histogram.

When the injector is assembled into an engine the performance of the injector may be from different ends of the statistical distribution. Although still within the overall specification, this can create variables in emissions of the vehicle. This mixture of rich and lean injectors directly affects the emissions.

As governmental standards have become tighter over the years, manufacturers continue to tighten the variability in static and dynamic flows. Industry goals today are in the range of +/−1½% for a given population. Tighter tolerances require the internal absorption of higher scrap levels, that ultimately shows itself in product cost.

It is seen then that it would be desirable to have a method for providing to a vehicle computer the exact technical data associated with any given fuel injector.

SUMMARY OF THE INVENTION

This need is met by the data retention and recall method according to the present invention, wherein technical test results for an injector are carried with the injector and downloaded to the vehicle computer, resulting in improved emissions.

Briefly, the invention comprises the implementation of an EEPROM technology feature onto a fuel injector. Principles of the invention are of course potentially applicable to forms of fuel injectors other than the one specifically herein illustrated and described and can be accomplished by a variety of data retention and recall means.

According to the present invention, a method for retaining and recalling technical data associated with a solenoid-operated fuel injector comprises the steps of testing technical data associated with the fuel injector and transferring the technical data results to the injector. The injector is then read at assembly to inform a vehicle computer of the technical specifications of the injector. Variations between injectors can be adjusted for, or offset, to accommodate variations and thereby improve engine emissions by presenting all injectors as being identical to the engine.

For a full understanding of the nature and objects of the present invention, reference may be had to the following detailed description taken in conjunction with the accompanying drawings and the appended claims.

DESCRIPTION OF THE PREFERRED EMBODIMENT

Figure 1:
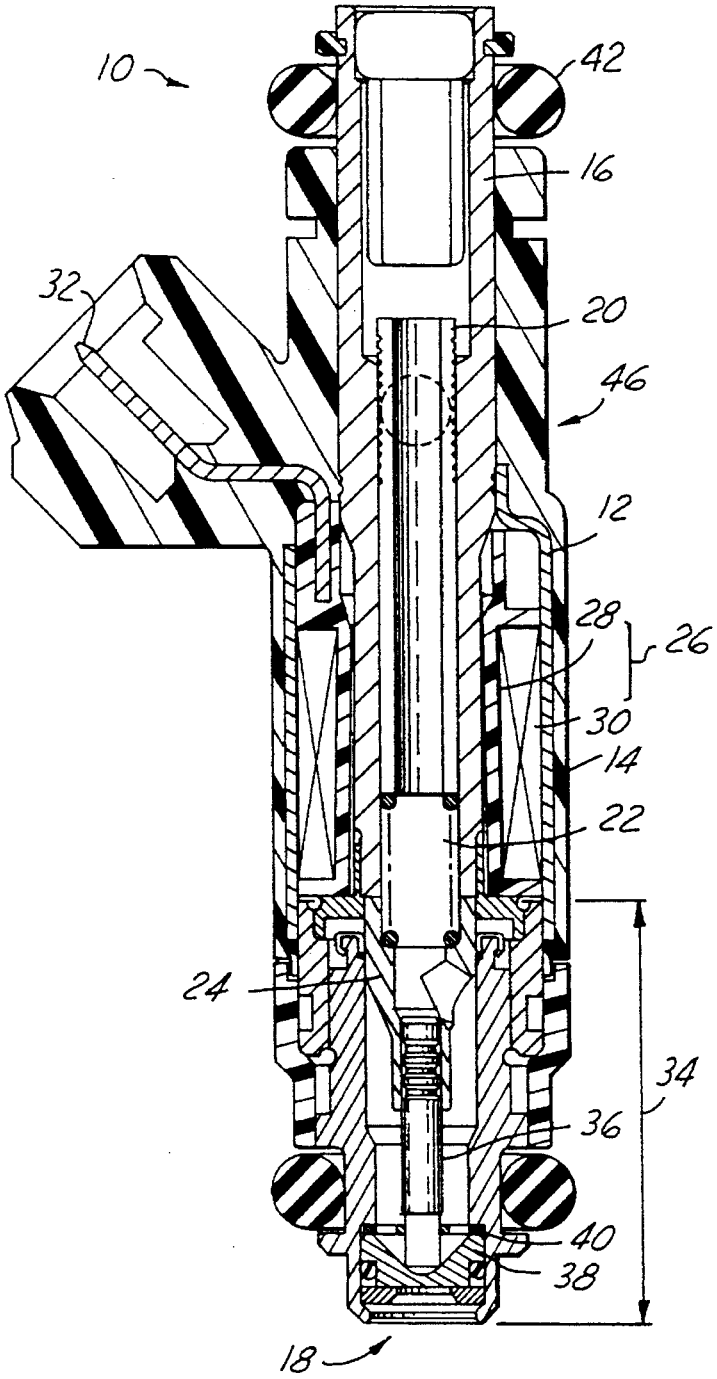
FIG. 1 is a cross section view of a typical fuel injector, having a technical data memory means attached to the injector, in accordance with the present invention.

In FIG. 1 there is illustrated partly in cross section, a typical fuel injector 10 designed to inject fuel into an internal combustion engine. The fuel injector 10 includes as its major components thereof a housing 12 of magnetically permeable material and an overmold housing 14; an inlet connector 16 in the form of a tube also of magnetically permeable material; an outlet end 18; an adjusting tube 20; a spring 22; an armature 24; a solenoid coil assembly 26, comprising a bobbin 28 and a wire 30; electrical terminals 32 via which the fuel injector is connected with an electrical operating circuit for selectively energizing the solenoid coil; and a valve body assembly 34. The armature 24 is movable between a first and second position for causing a needle valve, or guide pin, 36 to contact and separate from a valve seat 38, as the pin 36 moves within guide 40. Various sealing means, including o-ring 42, may also be included.

The relative organization and arrangement of these various parts are essentially the same as in the fuel injector of commonly assigned U.S. Pat. No. 4,610,080. The injector is of the type which is commonly referred to as a top-feed type, wherein fuel is introduced through inlet connector 16 and emitted as injections from the axially opposite nozzle, or tip, end 18.

The differences essentially relate to the inventive features of the present disclosure. Marking products with an identification code has become an essential part of the packaging and manufacturing process in many industries.

Figure 2:
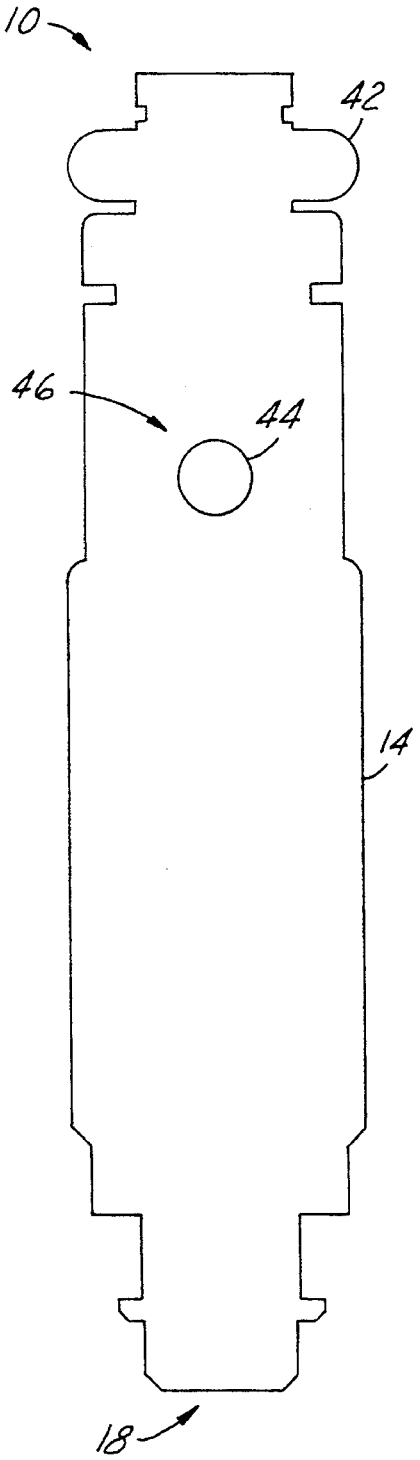
FIG. 2 illustrates one embodiment of the location of the memory means, attached to the injector of FIG. 1.

Referring now to FIG. 2, there is illustrated one embodiment of data retention according to the present invention, in the form of an EEPROM memory means 44 attached to injector 10. The memory means 44 is located on the exterior of the fuel injector 10 of FIG. 1, and is preferably attached on the side of the injector opposite the connector and terminals 32, at location 46. In a preferred embodiment of the present invention, the memory means is a metal disk or button, approximately ⅛" in diameter.

The present invention addresses a method to keep technical test results of an injector, such as static flow, dynamic flow, leak rate and opening time, with the injector. The data is preferably carried on the injector in EEPROM form, such as a memory chip. The data can then be downloaded to the vehicle computer. Associated software then "adjusts" or "offsets" given parameters to accommodate injector specification variations, thereby presenting all injectors as identical to the engine, resulting in improved emissions.

In a preferred embodiment of the present invention, any given injector, such as injector 10, is tested in manufacturing to provide technical data and specification information relating to that particular injector. The data is then transferred via a reader to a data retention means, such as memory button 44, attached to the injector. The memory button 44 does not require any internal battery source by utilizing EEPROM technology. Power is taken from the reader at the time of contact. Since no internal batteries are required, the memory button never runs out of power and requires no additional wiring at the injector/engine interface. The data is retained for the life of the injector and is not temperature dependent. Typical memory buttons 44 have four to eight bits of memory. The memory chip 44 is a "minidatabase" of information specified for the discrete injector.

The method of attachment of the memory chip 44 to the fuel injector 10 can be by any suitable means. For example, the attachment could be by encapsulation in the overmold plastic, or simply use of adhesive to form a pocket during the overmold process. Typical operating temperatures for memory are −40° F. to +185° F. without deterioration in performance.

The present invention, therefore, provides for a method of data retention and recall, and an "adjust" or "offset" of vehicle computer logic to collapse the variability of the injector to a single, centered, injector flow. In addition to the technical information, manufacturing information such as manufacturing date, lot control number, part number, lift setting, and assembly inner diameter number could be coded. As will be obvious to those skilled in the art, this process is applicable to all fuel injectors.

Having described the invention in detail and by reference to the preferred embodiments thereof, it will be apparent that principles of the invention are susceptible to being implemented in other forms to various injectors and other solenoid-operated valves without departing from the scope of the invention defined in the appended claims.

What is claimed is:

1. A method for retaining and recalling technical data associated with a solenoid-operated fuel injector comprises the steps of:

testing the fuel injector to generate technical data specifications relating to the fuel injector;

attaching a memory means to the fuel injector;

transferring the technical data specifications to the memory means attached to the fuel injector;

transferring the technical data specifications from the memory means to a vehicle computer;

using the vehicle computer to adjust for variations between fuel injectors to collapse variability of injectors to a single, centered injector flow.

2. A method for retaining and recalling technical data as claimed in claim 1 wherein the technical data specifications are carried on the fuel injector in EEPROM form.

3. A method for retaining and recalling technical data as claimed in claim 2 wherein the step of transferring the technical data specifications to the memory means attached to the fuel injector further comprises the step of using an EEPROM compatible reader to transfer the technical data specifications to the memory means.

4. A method for retaining and recalling technical data as claimed in claim 1 wherein the fuel injector comprises an overmold housing.

5. A method for retaining and recalling technical data as claimed in claim 4 wherein the step of attaching a memory means to the fuel injector comprises the step of encapsulating the memory means in the overmold housing.

6. A method for retaining and recalling technical data as claimed in claim 1 wherein the step of attaching a memory means to the fuel injector comprises the step of using an adhesive to attach the memory means to the fuel injector.

* * * * *